US010738476B2

(12) United States Patent
Moghimi

(10) Patent No.: US 10,738,476 B2
(45) Date of Patent: Aug. 11, 2020

(54) SUPPORT STRUCTURE FOR INSTALLING THIN BRICKS

(71) Applicant: Reza Moghimi, Tehran (IR)

(72) Inventor: Reza Moghimi, Tehran (IR)

( * ) Notice: Subject to any disclaimer, the term of this patent is extended or adjusted under 35 U.S.C. 154(b) by 0 days.

(21) Appl. No.: 16/396,712

(22) Filed: Apr. 28, 2019

(65) Prior Publication Data

US 2019/0249443 A1 Aug. 15, 2019

Related U.S. Application Data

(60) Provisional application No. 62/664,161, filed on Apr. 29, 2018.

(51) Int. Cl.
*E04F 13/08* (2006.01)
*E04B 1/88* (2006.01)

(52) U.S. Cl.
CPC ..... *E04F 13/0805* (2013.01); *E04B 1/88* (2013.01)

(58) Field of Classification Search
CPC . E04F 13/0805; E04F 13/147; E04F 13/0862; E04B 1/88
USPC ..... 52/408
See application file for complete search history.

(56) References Cited

U.S. PATENT DOCUMENTS 830,313 A * 9/1906 Fenn ..... E04F 13/0803 52/386
1,850,961 A * 3/1932 Mortenson ..... E04F 13/0801 52/387
2,054,573 A * 9/1936 Mendenhall ..... E04F 13/0803 52/385
2,078,069 A * 4/1937 Eliel ..... E04B 2/00 52/293.2
2,870,624 A * 1/1959 Sampson ..... F27D 1/004 52/479
3,740,911 A * 6/1973 O'Leary ..... E04F 13/0862 52/388
4,956,949 A * 9/1990 Francis ..... E04F 13/0821 52/38
5,228,937 A * 7/1993 Passeno ..... E04F 13/0801 156/297
5,501,049 A * 3/1996 Francis ..... E04F 13/0862 52/315
5,944,203 A * 8/1999 Vlah ..... A47F 5/0846 211/189

(Continued)

*Primary Examiner* — Jeanette E Chapman
(74) *Attorney, Agent, or Firm* — Bajwa IP Law Firm; Haris Zaheer Bajwa

(57) ABSTRACT

A support structure for installing planar rows of thin bricks on a wall may include a panel that may be mounted to a front surface of the wall, a plurality of tabs that may extend from a front surface of the panel and may be arranged in a plurality of horizontal rows of spaced-apart tabs, and a plurality of elongated support members, where each of the plurality of elongated support members may be removably attached to a corresponding horizontal row of spaced-apart tabs. Each of the plurality of elongated support members may include an upper support edge and a lower support edge, where the upper support edge may be configured to support lower surfaces of thin bricks that are placed immediately above each elongated support member and the lower support edge may be placed above and in contact with upper surfaces of thin bricks that are placed immediately below each elongated support member.

13 Claims, 8 Drawing Sheets

(56) References Cited

U.S. PATENT DOCUMENTS

| | | | | |
|---|---|---|---|---|
| 8,572,918 | B1 * | 11/2013 | Zhou | E04B 1/762<br>52/407.4 |
| 9,512,621 | B1 * | 12/2016 | Trezza | E04F 13/0875 |
| 2010/0077676 | A1 * | 4/2010 | Dobler | E04F 13/081<br>52/127.1 |

* cited by examiner

SUPPORT STRUCTURE FOR INSTALLING THIN BRICKS

CROSS-REFERENCE TO RELATED APPLICATION

This application claims the benefit of priority from U.S. Provisional Patent Application Ser. No. 62/664,161, filed on Apr. 29, 2018, and entitled "PANEL AND HOLDING PROFILE FOR THIN BRICK VENEER," which is incorporated herein by reference in its entirety.

TECHNICAL FIELD

The present disclosure relates to wall covering systems and particularly relates to systems and methods for installing brick or thin brick wall coverings.

BACKGROUND

An alternative for forming a traditional brick wall is a thin brick wall construction, where instead of stacking bricks on top of each other, a support panel is affixed to a front surface of a wall and then thinner bricks are mounted on the support panel. Grouting mortar may later be used to fill the gaps between thin bricks mounted on the support panel to create a façade similar to that of a traditional brick wall.

In a thin brick wall construction, thin bricks may be mounted on a support panel by adhesive materials. One problem with the use of adhesive materials for mounting thin bricks onto a support panel is that sometimes the adhesive may release and the thin bricks may fall off the support panel. Moreover, adhesive materials are expensive and they may sometimes cause unwanted smears on front surfaces of thin bricks.

Alternatively, thin bricks may be mounted on a support panel by mounting structures that are usually adapted for mounting specific thin bricks with specific shapes and sizes, which impose a lot of limitations on a user's choice of thin bricks. Moreover, these mounting structures provide only a limited number of mounting locations on the support panel and may require a large amount of force to mount the thin bricks on the support panel. Sometimes hammer strikes are required to mount the bricks on these mounting structures which may cause additional problems, such as breaking the thin bricks.

Therefore, there is a need for systems and methods for installing thin brick structures that allow for installing thin bricks on a wall without a need for adhesive materials or specific types of thin bricks with limited sizes and shapes. There is further a need for systems and methods for installing thin brick structures that provide an easier mounting mechanism for thin bricks, in which only a small amount of force is required to tightly mount thin bricks on a support panel.

SUMMARY

This summary is intended to provide an overview of the subject matter of the present disclosure, and is not intended to identify essential elements or key elements of the subject matter, nor is it intended to be used to determine the scope of the claimed implementations. The proper scope of the present disclosure may be ascertained from the claims set forth below in view of the detailed description below and the drawings.

According to one or more exemplary embodiment, the present disclosure is directed to a support structure for installing planar rows of thin bricks on a wall may include a panel that may be mounted to a front surface of the wall, a plurality of tabs that may extend from a front surface of the panel and may be arranged in a plurality of horizontal rows of spaced-apart tabs, and a plurality of elongated support members, where each of the plurality of elongated support members may be removably attached to a corresponding horizontal row of spaced-apart tabs. Each of the plurality of elongated support members may include an upper support edge and a lower support edge, where the upper support edge may be configured to support lower surfaces of thin bricks that are placed immediately above each elongated support member and the lower support edge may be placed above and in contact with upper surfaces of thin bricks that are placed immediately below each elongated support member.

In an exemplary embodiment, each of the plurality of tabs may perpendicularly extend from the front surface of the panel along a surface normal of the panel. In an exemplary embodiment, each tab of the plurality of tabs may include an aperture, where a tangent plane to the aperture may be perpendicular to a tangent plane to the front surface of the panel.

In an exemplary embodiment, each elongated support member may further include a front wall, where a tangent plane to the front wall may be parallel with the tangent plane to the front surface of the panel. In an exemplary embodiment, the front wall may include a plurality of perforations on the front wall, a plurality of upper lips extending from an upper edge of the front wall, a plurality of lower lips extending from a lower edge of the front wall, a front surface facing away from the front surface of the wall, and a rear surface facing the front surface of the wall.

In an exemplary embodiment, each elongated support member may further include a latching mechanism that may be configured to removably attach each elongated support member to a corresponding horizontal row of spaced-apart tabs. In an exemplary embodiment, the exemplary latching mechanism may include one or more protruded tongues that may be attached to the rear surface of the front wall, where each protruded tongue may be associated with and latched onto each tab of the corresponding horizontal row of spaced-apart tabs.

In an exemplary embodiment, each protruded tongue of the plurality of protruded tongues may include a protrusion along an axis parallel to a tangent plane of the front wall. In an exemplary embodiment, each protruded tongue of the plurality of protruded tongues may mate with the aperture of each tab of the corresponding horizontal row of spaced-apart tabs.

In an exemplary embodiment, the latching mechanism may further include an upper arched arm that may be configured to attach the plurality of protruded tongues to the rear surface of the front wall. In an exemplary embodiment, the upper arched arm may include a first upper portion attached to and extending from the rear surface of the front wall, a first front curved portion extending from the first upper portion curving downward and toward the rear surface of the front wall, and a first lower portion extending straight from the first front curved portion toward the rear surface of the front wall. The plurality of protruded tongues may be attached to the first lower portion, and each protruded tongue of the plurality of protruded tongues may include a protrusion along a surface normal of the first lower portion.

In an exemplary embodiment, the latching mechanism may further include a lower arched arm. The exemplary lower arched arm may include a second lower portion attached to and extending from the rear surface of the front wall, a second front curved portion extending from the second lower portion curving upward and toward the rear surface of the front wall, and a second upper portion extending straight from the second front curved portion toward the rear surface of the front wall. A plurality of slots may be cut into the second upper portion, where each slot of the plurality of slots may be associated with a protruded tongue of the plurality of protruded tongues.

In an exemplary embodiment, each protruded tongue of the plurality of protruded tongues may include a V-shaped protrusion along an axis parallel to the tangent plane of the front wall.

In an exemplary embodiment, the plurality of lower lips of a first elongated support member of the plurality of elongated support members may be spaced apart from the plurality of upper lips of a second elongated support member positioned below the first elongated support member by an amount equal to a width of each row of thin bricks mounted between the first elongated support member and the second elongated support member.

In an exemplary embodiment, the panel may include one or more countersunk holes, where each countersunk hole may protrude from a rear surface of the panel creating a space between the front surface of the wall and the rear surface of the panel. The panel may be attached to the front surface of the wall by fastening one or more countersunk fasteners through the one or more countersunk holes.

According to one or more exemplary embodiments, the present disclosure is directed to a method for installing thin bricks on a front surface of a wall. The exemplary method may include mounting a panel to the front surface of the wall, where the panel may include a plurality of tabs extending from a front surface of the panel and the plurality of tabs may be arranged in a plurality of horizontal rows of spaced-apart tabs. The exemplary method may further include latching a plurality of elongated support members onto corresponding horizontal rows of spaced-apart tabs, placing rows of thin bricks above corresponding plurality of elongated support members, and fixing the rows of thin bricks between two elongated support members of plurality of elongated support members by depositing a grouting mortar material on the front surface of the panel between the rows of thin bricks.

BRIEF DESCRIPTION OF THE DRAWINGS

The drawing figures depict one or more implementations in accord with the present teachings, by way of example only, not by way of limitation. In the figures, like reference numerals refer to the same or similar elements.

DETAILED DESCRIPTION

In the following detailed description, numerous specific details are set forth by way of examples to provide a thorough understanding of the relevant teachings related to the exemplary embodiments. However, it should be apparent that the present teachings may be practiced without such details. In other instances, well known methods, procedures, components, and/or circuitry have been described at a relatively high-level, without detail, in order to avoid unnecessarily obscuring aspects of the present teachings.

The following detailed description is presented to enable a person skilled in the art to make and use the methods and devices disclosed in exemplary embodiments of the present disclosure. For purposes of explanation, specific nomenclature is set forth to provide a thorough understanding of the present disclosure. However, it will be apparent to one skilled in the art that these specific details are not required to practice the disclosed exemplary embodiments. Descriptions of specific exemplary embodiments are provided only as representative examples. Various modifications to the exemplary implementations will be plain to one skilled in the art, and the general principles defined herein may be applied to other implementations and applications without departing from the scope of the present disclosure. The present disclosure is not intended to be limited to the implementations shown, but is to be accorded the widest possible scope consistent with the principles and features disclosed herein.

In an exemplary embodiment, a support structure and a method are disclosed for installing planar rows of covering elements, such as thin bricks on a wall. The exemplary support structure and the exemplary method may allow for installing planar rows of thin bricks with any given shape and size-without a need for adhesive materials. The exemplary support structure may include two main parts, a panel that may be mounted to a front surface of a wall and one or more elongated support members that may be mounted to a front surface of the panel. The exemplary elongated support members may form rows of horizontal support surfaces on the front surface of the panel, between which, rows of thin bricks may be installed on the panel.

Specifically, the exemplary panel may be mounted to the wall by fasteners such as screws without a need for any adhesive material or mortar and the exemplary elongated support members may be latched onto the panel by integrated latching mechanisms on the exemplary elongated support members without a need for any adhesive material or mortar. In terms of different shapes and sizes of thin bricks, the exemplary support structure may allow for attaching elongated support members at different heights on the panel so as to configure the front surface of the panel corresponding to the size and pattern of the bricks that are to be installed on the wall.

Figure 1A:
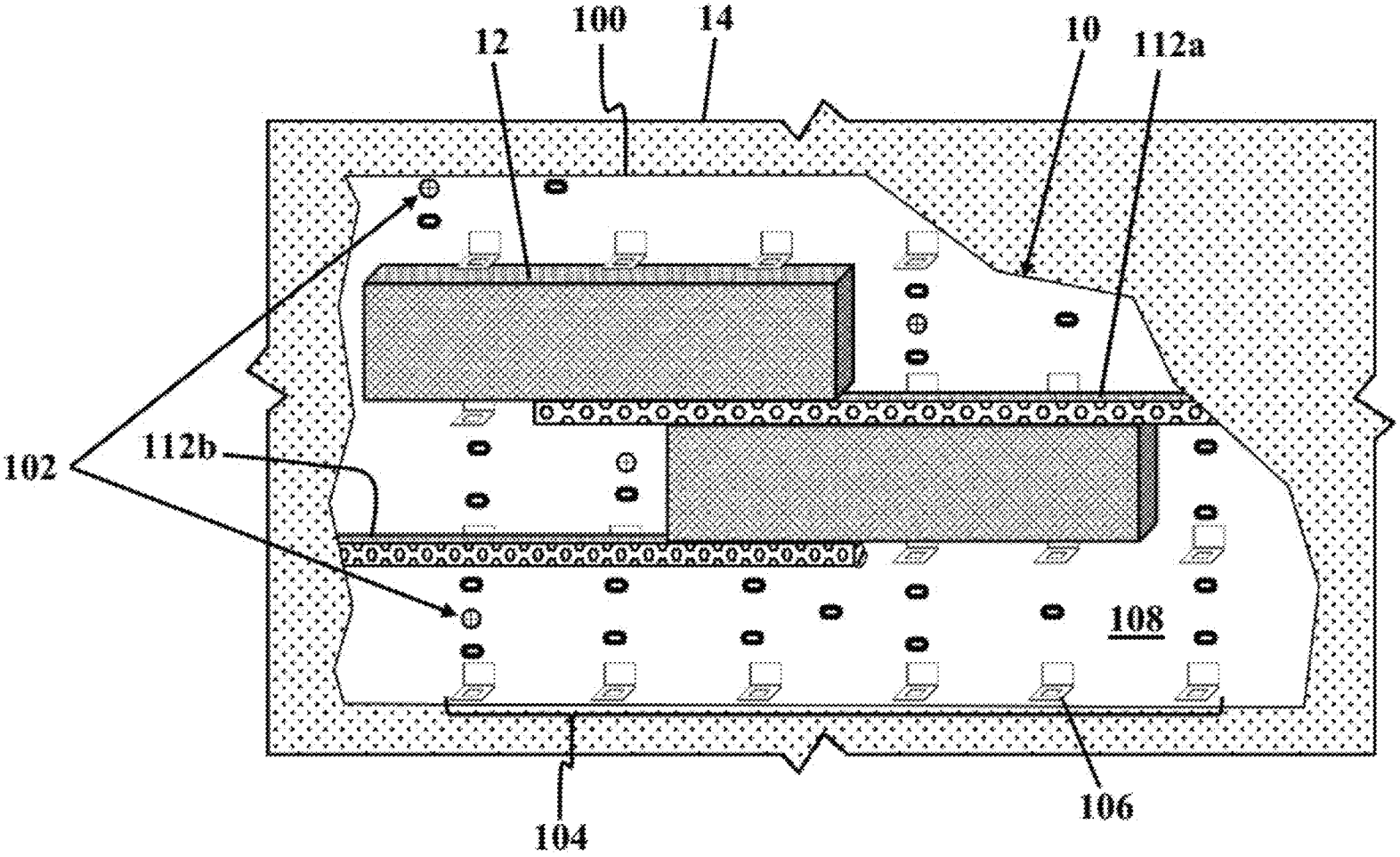
FIG. 1A illustrates a support structure for installing thin bricks on n wall, consistent with one or more exemplary embodiments of the present disclosure.

FIG. 1A illustrates a support structure 10 for installing thin bricks 12 on a surface of a wall 14, consistent with one or more exemplary embodiments of the present disclosure. In an exemplary embodiment, support structure 10 may include panel 100 that may be mounted to wall 14 by fasteners such as screws 102. In an exemplary embodiment, wall 14 may be any surface on which a thin brick covering may be installed. In an exemplary embodiment, panel 100 may either cover an entire exterior surface of a wall or a number of smaller panels similar to panel 100 may be tiled on the wall to cover the entire surface of the wall. Tiled panels may have side-to-side gaps in-between to account for thermal expansion of the panels and to avoid bends and distortions. In an exemplary embodiment, panel 100 may be a flexible panel that may have curved or bent sections to cover corners and curved surfaces of wall 14. As used herein, a flexible panel may refer to a panel made of a material that may allow for bending or curving the panel by available metal sheet forming methods.

In an exemplary embodiment, support structure 10 may further include one or more tabs that may be arranged in one or more horizontal spaced-apart rows on panel 100, such as horizontal row of spaced-apart tabs 104. In an exemplary embodiment, each tab, such as tab 106 in each row of spaced-apart tabs, such as horizontal row of spaced-apart tabs 104 may be punched out of panel 100 and may extend from a front surface 108 of panel 100.

Figure 1B:
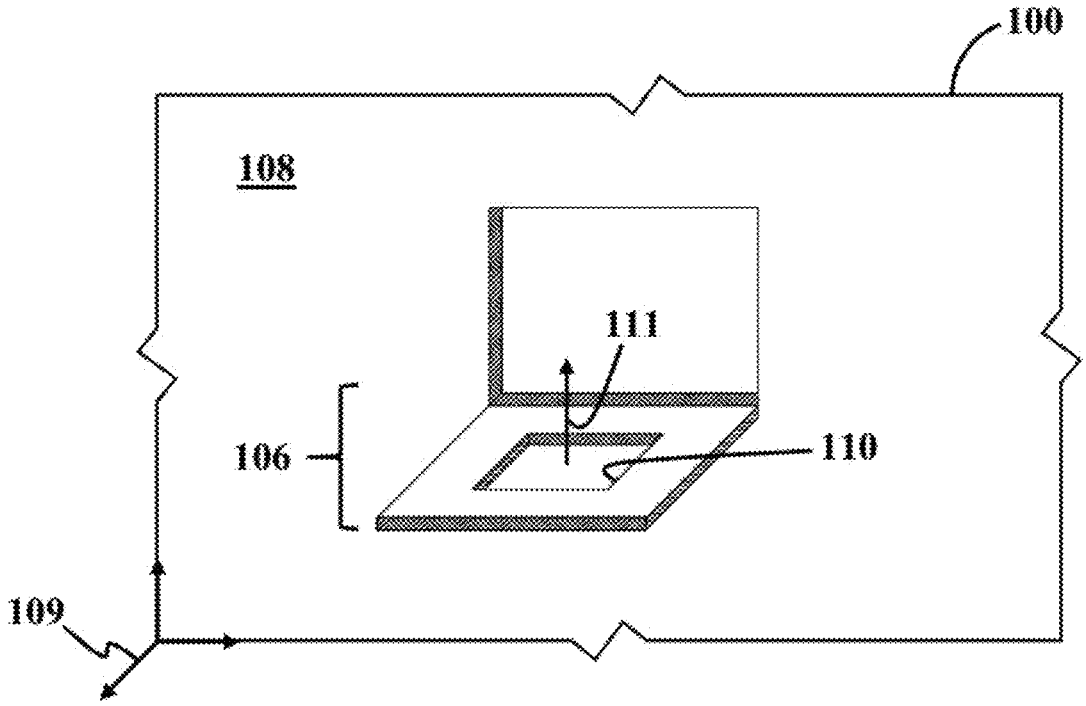
FIG. 1B illustrates a perspective view of a tab, consistent with one or more exemplary embodiments of the present disclosure.

FIG. 1B illustrates a perspective view of tab 106, consistent with one or more exemplary embodiments of the present disclosure. In an exemplary embodiment, tab 106 may perpendicularly extend from front surface 108 of panel 100 along a surface normal 109 of panel 100. As used hereinafter, a surface normal of a surface or object may refer to a line or axis perpendicular to a tangent plane to that surface or object. In an exemplary embodiment, each tab may include an aperture, for example, tab 106 may include aperture 110. A tangent plane to aperture 110 may lay parallel to a tangent plane of tab 106. In other words, a surface normal 111 of aperture 110 may be perpendicular to surface normal 109 of panel 100.

In an exemplary embodiment, support structure 10 may further include one or more elongated support members, such as elongated support members (112*a*, 112*b*) that may be removably mounted to the corresponding horizontal rows of spaced-apart tabs. In an exemplary embodiment, spaced-apart rows of elongated connecting members such as elongated support members (112*a*, 112*b*) may provide horizontal support surfaces, on which rows of thin bricks may be installed and supported.

Figure 2A:
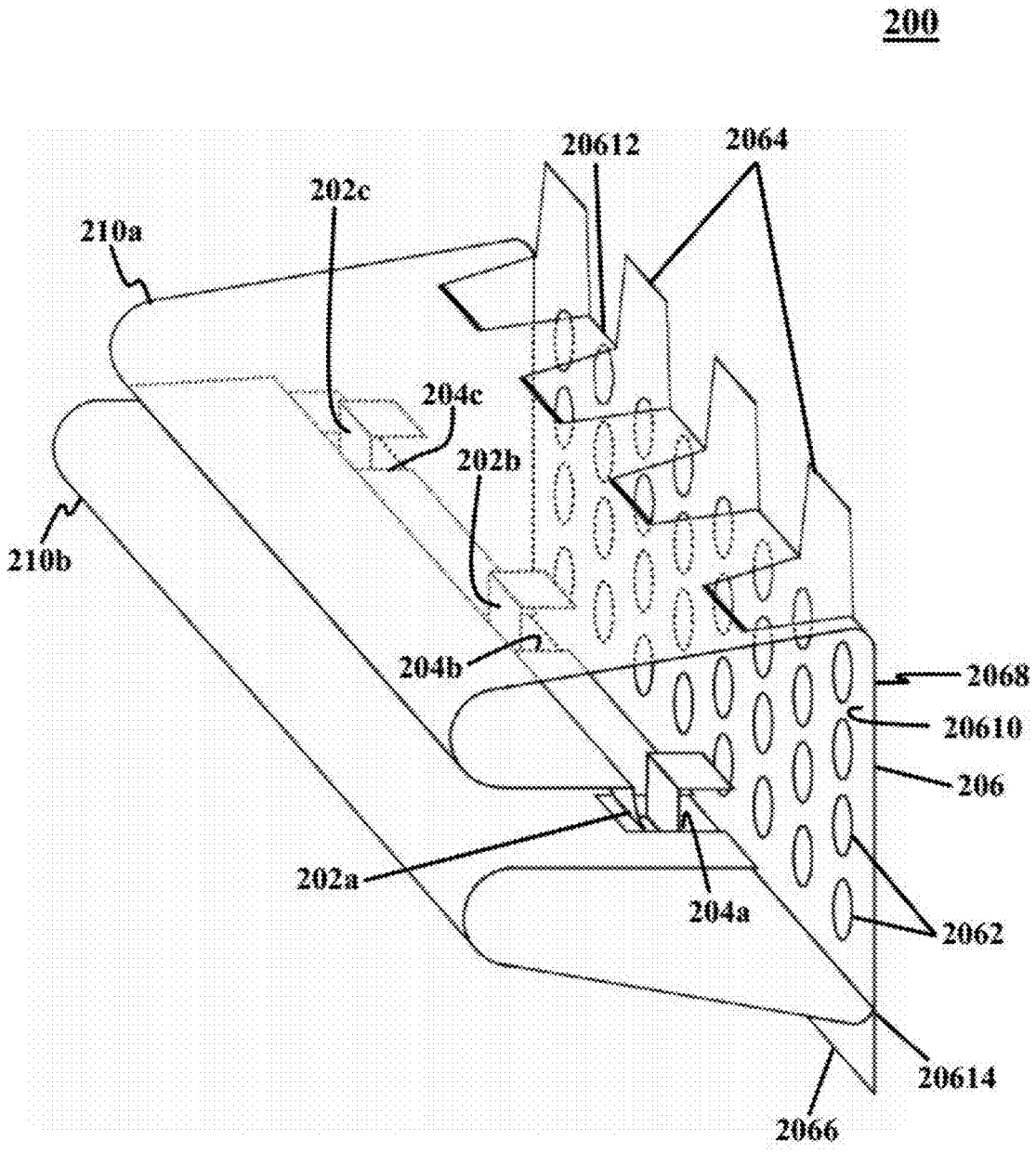
FIG. 2A illustrates a perspective view of an elongated support member, consistent with one or more exemplary embodiments of the present disclosure.
Figure 2B:
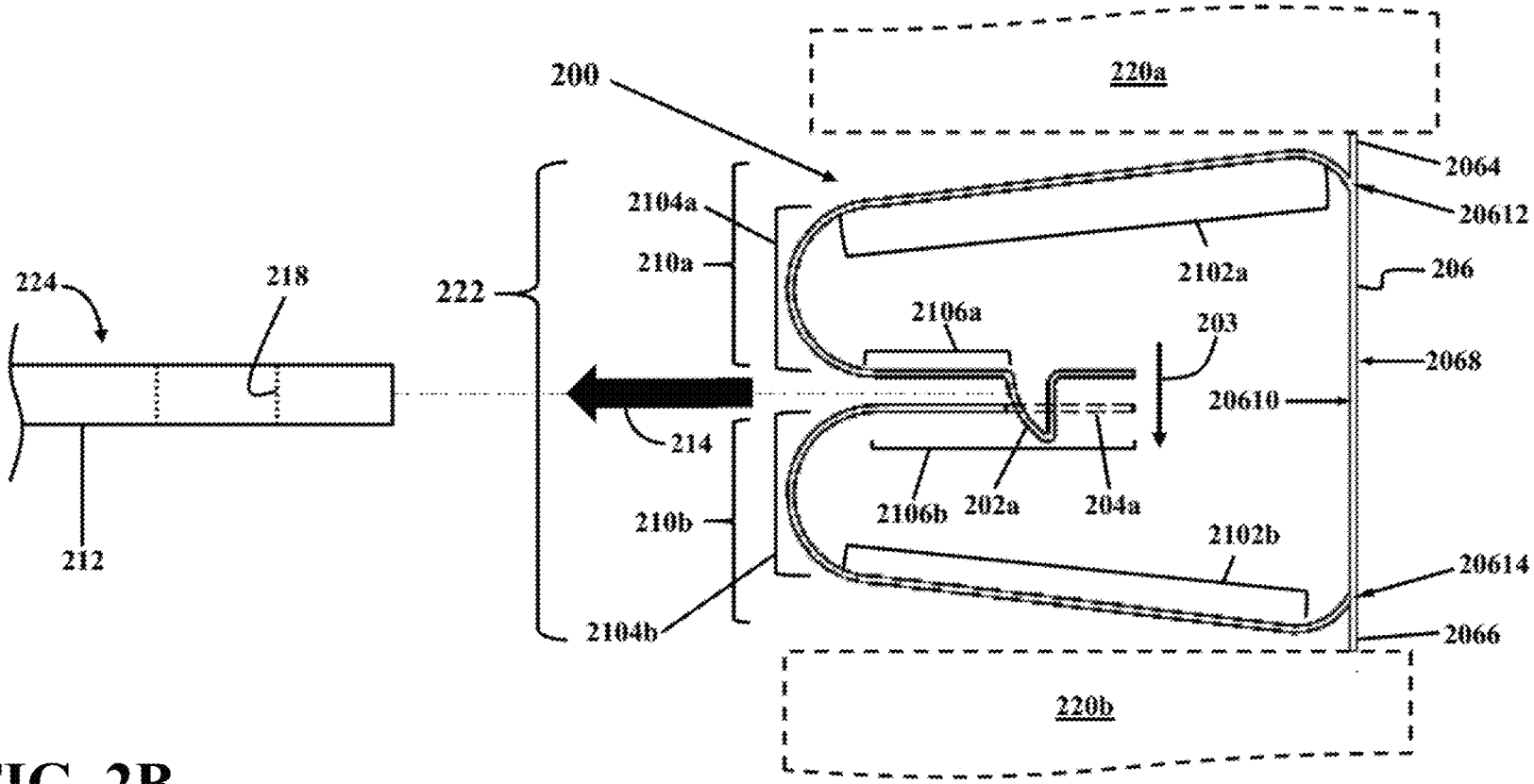
FIG. 2B illustrates a side-view of an elongated support member, consistent with one or more exemplary embodiments of the present disclosure.

FIG. 2A illustrates a perspective view of an elongated support member 200, consistent with one or more exemplary embodiments of the present disclosure. FIG. 2B illustrates a side-view of elongated support member 200, consistent with one or more exemplary embodiments of the present disclosure. In an exemplary embodiment, elongated support member 200 may be similar to elongated support members (112*a*, 112*b*) of FIG. 1.

Referring to FIGS. 2A and 2B, in an exemplary embodiment, elongated support member 200 may include an elongated front wall 206. A tangent plane to front wall 206 may be parallel with a tangent plane to panel 100. In an exemplary embodiment, front wall 206 may include one or more perforations 2062, one or more extended upper lips 2064, one or more extended lower lips 2066, a front surface 2068 facing away from front surface 108 of panel 100, and a rear surface 20610 facing front surface 108 of panel 100.

In an exemplary embodiment, one or more extended upper lips 2064 may extend upward from an upper edge 20612 of front wall 206 and may provide an upper support edge, on which a row of thin bricks 220*a* may be placed immediately above elongated support member 200. In an exemplary embodiment, one or more extended lower lips 2066 may extend downward from a lower edge 20614 of front wall 206 and may provide a lower support edge that may be placed above and in contact with upper surface of a row of thin bricks 220*b* positioned immediately below elongated support member 200.

In an exemplary embodiment, elongated support member 200 may further include an integrated latching mechanism 222 that may be configured to removably attach elongated support member 200 to a corresponding row of spaced-apart tabs 224. A side-view of a single tab 212 of row of spaced-apart tabs 224 is illustrated in FIG. 2B. In an exemplary embodiment, tab 212 may be similar to tab 106 of FIG. 1B and may include an aperture 218 similar to aperture 110.

In an exemplary embodiment, latching mechanism 222 may include one or more protruded tongues, such as protruded tongues 202*a*, 202*b*, and 202*c*—that may be attached to rear surface 20610 of front wall 206. In an exemplary embodiment, each protruded tongue, for example, protruded tongue 202*a* may include a protrusion along an axis 203 parallel to a tangent plane to front wall 206. In an exemplary embodiment, each protruded tongue, for example, protruded tongue 202*a* may be associated with and latched onto a corresponding tab of a horizontal row of spaced-apart tabs, for example tab 212. For example, protruded tongue 202*a* may latch onto tab 212, which, as used herein, may refer to protruded tongue 202*a* mating with aperture 218 of tab 212. In other words, aperture 218 of tab 212 may function as a catch in which protruded tongue 202*a* may move in response to aperture 218 moving into alignment with protruded tongue 202*a*.

Referring to FIG. 2B, in an exemplary embodiment, latching mechanism 222 may further include an upper arched arm 210*a* that may attach the one or more protruded tongues including protruded tongue 202*a* to rear surface 20610 of front wall 206. In an exemplary embodiment, upper arched arm 210*a* may include a first upper portion 2102*a* that may be attached to and extend from rear surface 20610 of front wall 206, a first front curved portion 2104*a* that may extend from first upper portion 2102*a* and may curve downward and toward rear surface 20610 of front wall 206, and a first lower portion 2106*a* that may extend from first front curved portion 2104*a* toward rear surface 20610 of front wall 206. In an exemplary embodiment, the one or more protruded tongues, such as protruded tongue 202*a* may be attached to first lower portion 2106*a*. In an exemplary embodiment, protruded tongue 202*a* may include a V-shaped protrusion extended downward along a surface normal of first lower portion 2106*a*, which is parallel with axis 203.

In an exemplary embodiment, latching mechanism 222 may further include a lower arched arm 210*b* that may be configured to exert a force onto a lower surface of each tab in horizontal row of spaced-apart tabs 214, for example, onto a lower surface of tab 212 when tab 212 is placed between upper arched arm 210*a* and lower arched arm 210*b* and protruded tongue 202*a* is latched into aperture 218. In exemplary embodiments, this arrangement of upper arched arm 210*a* and lower arched arm 210*b* may ensure a firm attachment of elongated support member 200 to horizontal row of spaced-apart tabs 224 by exerting an upward force to tab 212 and forcing protruded tongue 202*a* to maintain its latched position within aperture 218.

In an exemplary embodiment, lower arched arm 210*b* may include a second lower portion 2102*b* that may be attached to and extend from rear surface 20610 of front wall 206, a second front curved portion 2104*b* that may extend from second lower portion 2102*b* and may curve upward and toward rear surface 20610 of front wall 206, and a second upper portion 2106*b* that may extend from second front curved portion 2104*b* toward rear surface 20610 of front wall 206. In an exemplary embodiment, one or more slots, for example slots 204*a*, 204*b*, and 204*c* may be cut into second upper portion 2106*b*, where each slot, such as slot 204*a* may be associated with a protruded tongue such as protruded tongue 202*a*.

In an exemplary embodiment, one or more protruded tongues 202*a-c* and corresponding one or more slots 204*a-c* may be equally spaced-apart and the space between two adjacent protruded tongues may be equal to a space between two adjacent corresponding tabs in a row of spaced-apart tabs on panel 100. In an exemplary embodiment, elongated support member 200 may be mounted to a row of spaced-apart tabs on panel 100 by placing elongated support member 200 parallel to the row of spaced-apart tabs such that one or more protruded tongues 202*a-c* on elongated support member 200 may be aligned with corresponding tabs in the row of spaced-apart tabs. For example, elongated member 200 may be placed parallel to row of spaced-apart tabs 224 such that, protruded tongue 202*a* of elongated support member 200 may be aligned with corresponding tab 212 of row of spaced-apart tabs 224. In an exemplary embodiment, elongated support member 200 may then be pushed onto tab 212 in a direction shown by arrow 214. Tab 212 may spread apart upper arched arm 210*a* and lower arched arm 210*b* and may move into elongated support member 200 between upper arched arm 210*a* and lower arched arm 210*b*. After that, by pushing elongated support member 200 further onto tab 212, tab 212 may push protruded tongue 202*a* up and move under protruded tongue 202*a* until aperture 218 of tab 212 moves into alignment with protruded tongue 202*a* and slot 204*a*. In this instant, protruded tongue 202*a* may move to a latched position within aperture 218 so that protruded tongue 202*a* may block removal of elongated support member 200 from tab 212.

In an exemplary embodiment, elongated support member 200 may be made of a resilient material, such that upper arched arm 210*a* and lower arched arm 210*b* may tend to maintain their closed positions to each other where one or more protruded tongues 202*a-c* may be positioned within slots 204*a-c*, unless an external force separates them. For example, when elongated support member 200 is pushed onto a row of spaced-apart tabs on panel 100, tabs in the row of spaced-apart tabs, such as tab 212 may move between upper arched arm 210*a* and lower arched arm 210*b* and in response to the force exerted by tab 212 and other similar tabs in the row of spaced-apart tabs, upper arched arm 210*a* and lower arched arm 210*b* may be spread apart and as aperture 208 of tab 212 and other similar apertures on other tabs move into alignment with one or more protruded tongues 202*a-c*, upper arched arm 210*a* and lower arched arm 210*b* resiliently return to their closed position and as a result one or more protruded tongues 202*a-c* may be latched within aperture 218 and other similar apertures that are aligned with one or more protruded tongues 202*a-c*.

Figure 3A:
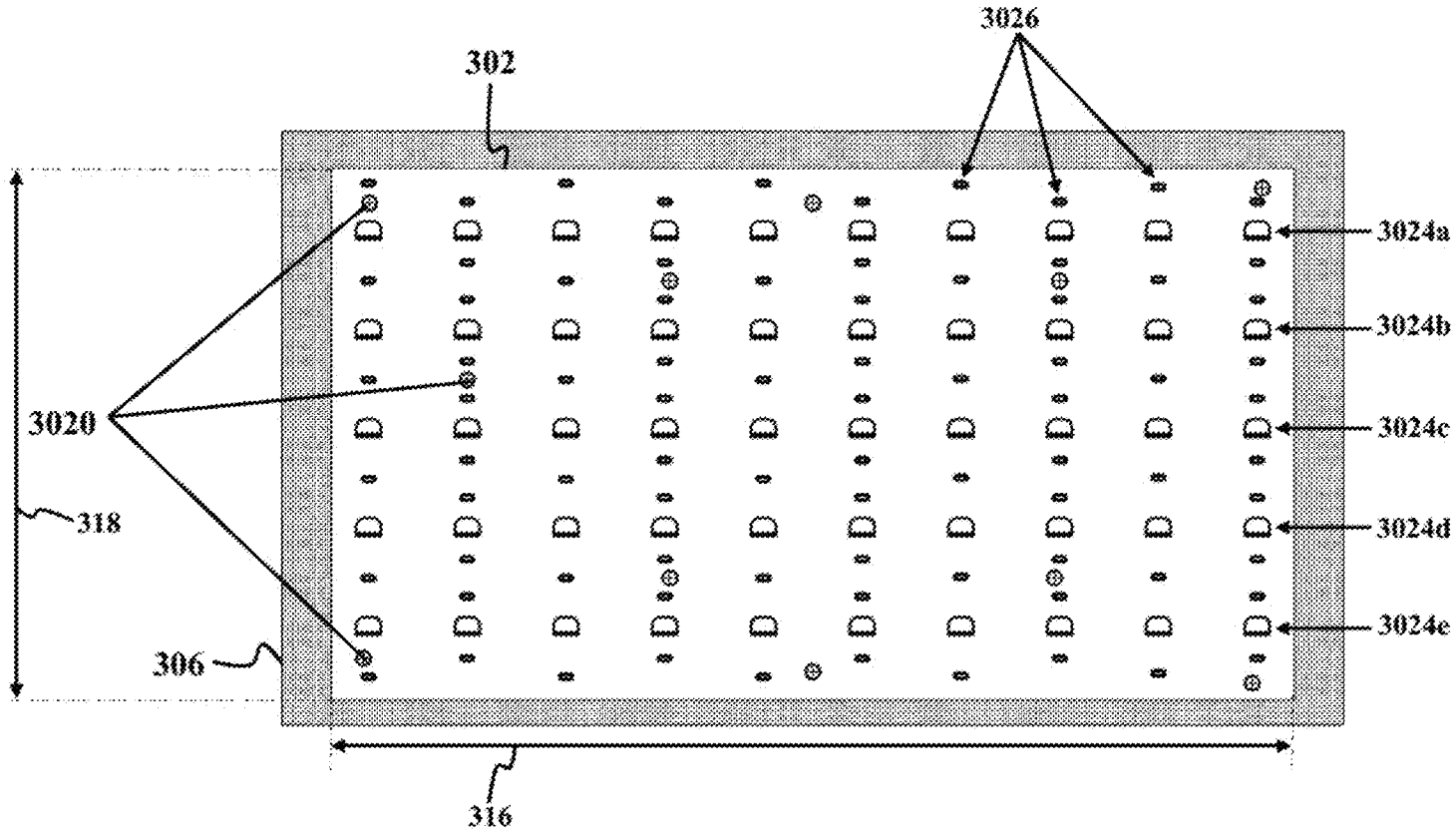
FIG. 3A illustrates a front view of a panel, consistent with one or more exemplary embodiment of the present disclosure.
Figure 3B:
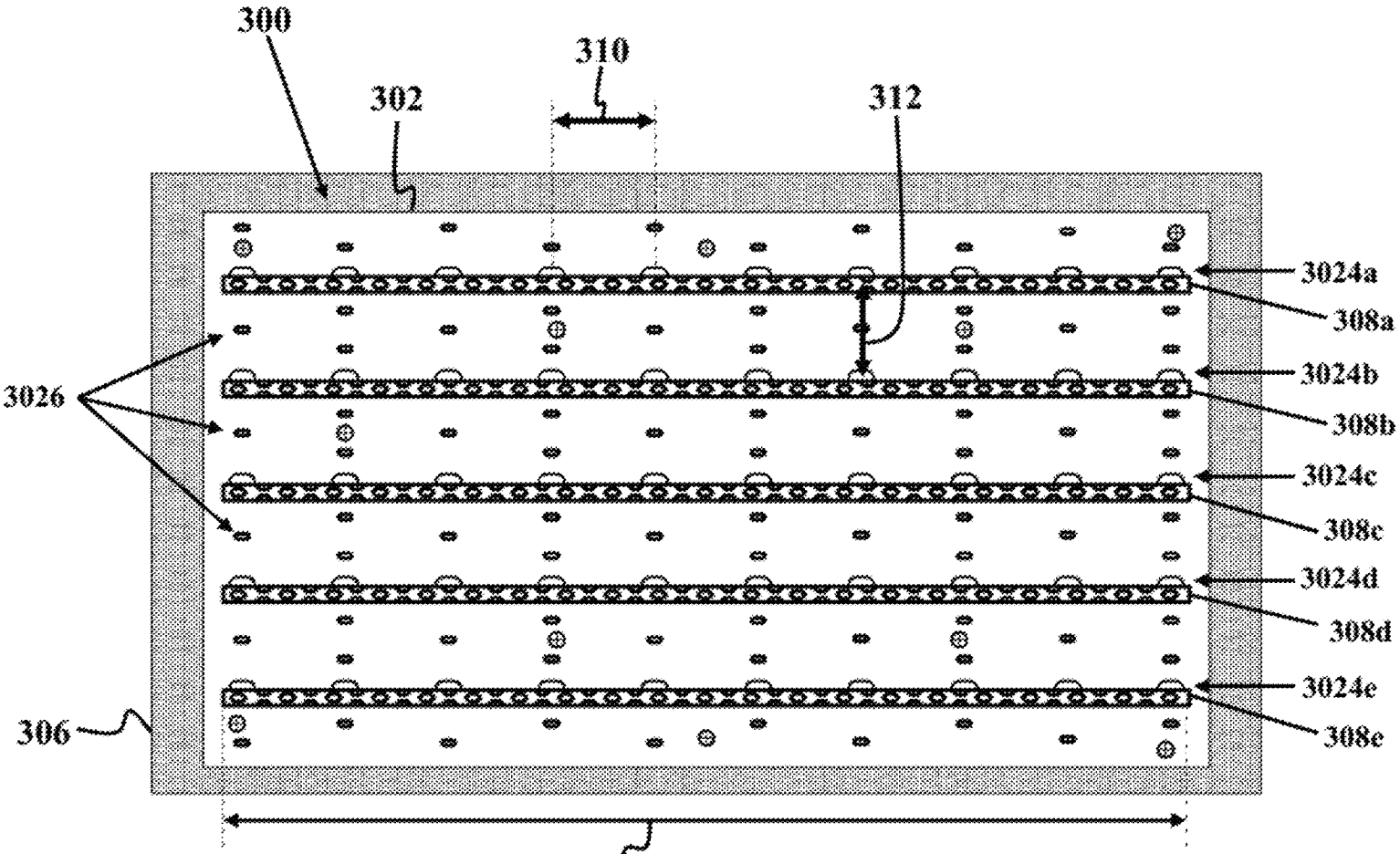
FIG. 3B illustrates a front view of a support structure, consistent with one or more exemplary embodiments of the present disclosure.
Figure 3C:
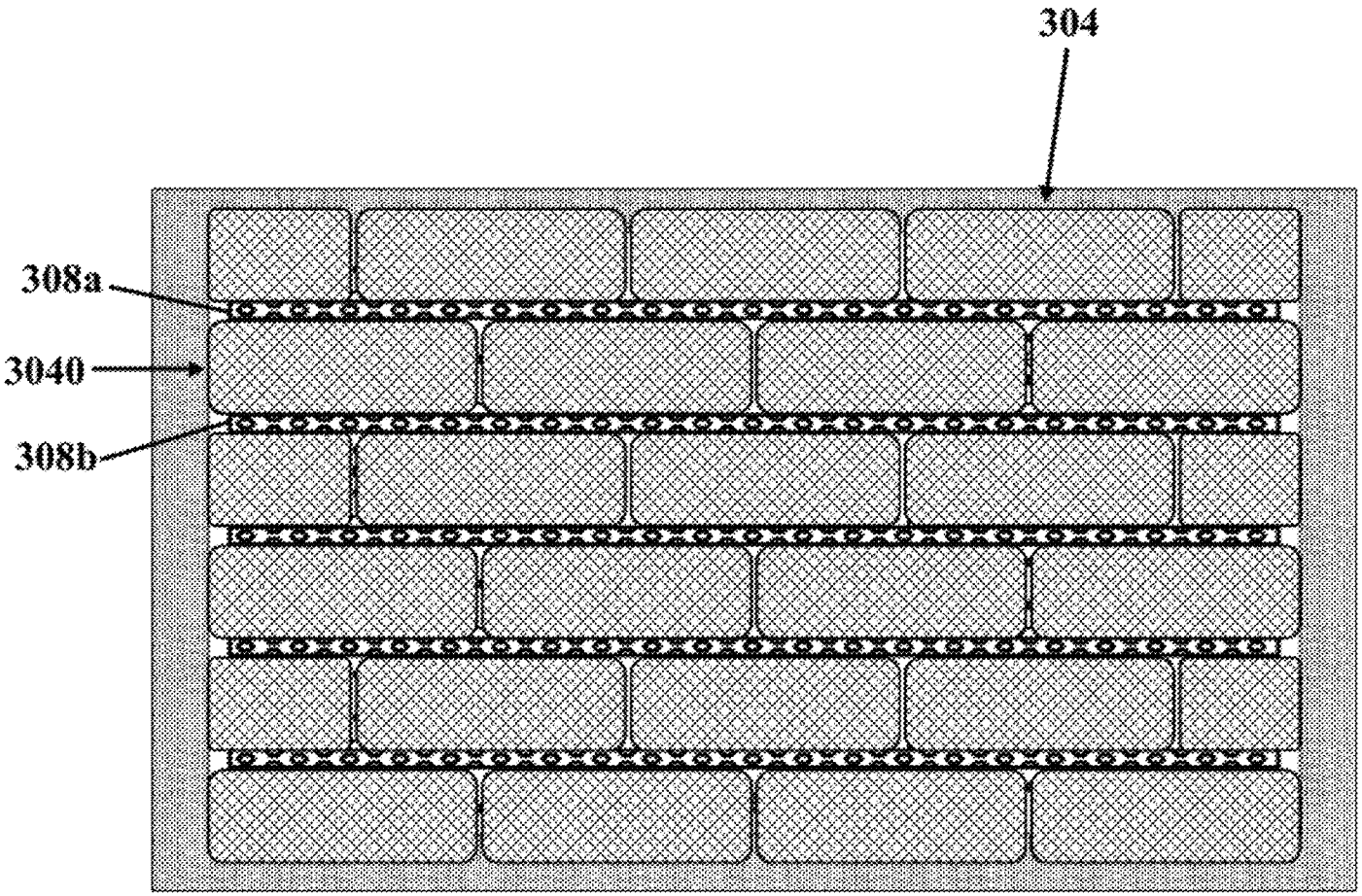
FIG. 3C illustrates a thin brick covering installed on a support structure, consistent with one or more exemplary embodiment.
Figure 3D:
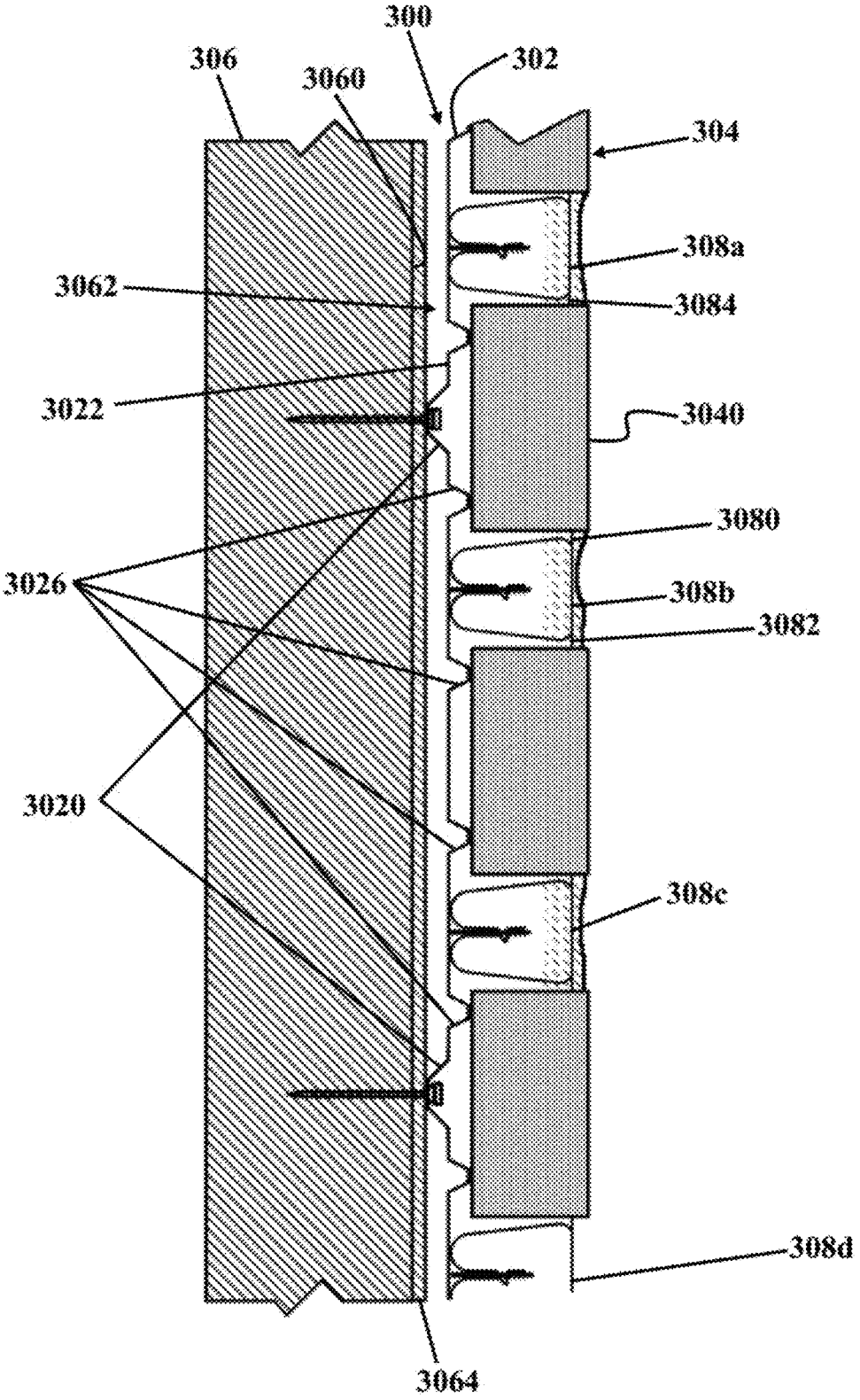
FIG. 3D illustrates a sectional side-view of a thin brick covering mounted on a support structure, consistent with one or more exemplary embodiments of the present disclosure.

FIG. 3A illustrates a front view of a panel 302, consistent with one or more exemplary embodiment of the present disclosure. FIG. 3B illustrates a front view of a support structure 300, consistent with one or more exemplary embodiments of the present disclosure. FIG. 3C illustrates a thin brick covering 304 installed on support structure 300, consistent with one or more exemplary embodiment. FIG. 3D illustrates a sectional side-view of thin brick covering 304 mounted on support structure 300, consistent with one or more exemplary embodiments of the present disclosure. In an exemplary embodiment, support structure 300 may be similar to support structure 10 and panel 302 may be similar to panel 100 of FIG. 1.

In an exemplary embodiment, panel 302 may include one or more countersunk holes 3020 that may be utilized for mounting panel 302 to a wall 306 such as a front surface of a wall by countersunk bolts, screws, or rivets. Countersunk holes 3020 may include recessed portions on panel 302 that may create a distance between a rear surface 3022 of panel 302 and front surface 3060 of wall 306. In other words, recessed countersunk holes 3020 on panel 302 that appear as projections on rear surface 3022 of panel 302 may function as spacers that may create a space 3062 between panel 302 and wall 306. In an exemplary embodiment, space 3062 may allow for an efficient drainage of moisture behind panel 302 and may further function as an insulating layer behind panel 302. In an exemplary embodiment, an insulating layer 3064 may further be installed between panel 302 and front surface 3060 of wall 306. Insulating layer 3064 may include one of a heat insulating material, a sound insulating material or a moisture insulating material. For example, insulating layer 3064 may be an expanded foam plastic such as polystyrene or a fiberglass layer. In exemplary embodiments, such configuration of space 3062 and insulating layer 3064 may provide insulating capabilities for support structure 300.

In an exemplary embodiment, panel 302 may further include one or more arrays of spaced-apart tabs 3024*a-e* similar to array of spaced-apart tabs 104 of FIG. 1. In an exemplary embodiment, any tabs in one or more arrays of spaced-apart tabs 3024*a-e* may be pressed back into panel 302 so as to adjust the space between adjacent tabs in arrays of spaced-apart tabs 3024*a-e* in accordance with or corresponding to the size and patterns of thin bricks that are to be installed on panel 302. In an exemplary embodiment, one or more arrays of spaced-apart tabs 3024*a-e* may be formed by punching panel 302 in a lancing operation, where panel 302 may be sheared and bent with one strike of a die. In an exemplary embodiment, one or more arrays of spaced-apart tabs 3024*a-e* may include D-shaped tabs that may be punched out of panel 302.

In an exemplary embodiment, panel 302 may further include one or more bumps 3026 that may be scattered on panel 302 between one or more arrays of spaced-apart tabs 3024*a-e*. In an exemplary embodiment, bumps 3026 may include projections created on a front surface of panel 302 such that when thin bricks are installed on panel 302, rear surfaces of thin bricks may rest on bumps 3026. In exemplary embodiments, such arrangement of bumps 3026 on panel 302 may further adjust the distance between rear surfaces of thin bricks and the front surface of panel 302.

In an exemplary embodiment, support structure 300 may further include one or more elongated support members 308*a-e* that may be mounted on corresponding one or more arrays of spaced-apart tabs 3024*a-e* by pushing one or more elongated support members 308*a-e* onto corresponding one or more arrays of spaced-apart tabs 3024*a-e* as was described in connection to FIG. 2B.

In an exemplary embodiment, each elongated support member of one or more elongated support members 308*a-e* may include an upper extended lip and a lower extended lip. The upper extended lip may provide a support edge for adjacent upper thin bricks to rest upon each elongated support member while the lower extended lip may help hold adjacent lower thin bricks fixed in position. For example, elongated support member 308*b* may include an upper extended lip 3080 similar to upper extended lip 208*a* and a lower extended lip 3082 similar to lower extended lip 208*b*. In an exemplary embodiment, each row of thin bricks may be installed between two adjacent upper and lower elongated support members and may be held fixed in place between a lower extended lip of the upper elongated support member and an upper extended lip of the lower support member. For example, row 3040 of thin bricks may be installed between elongated support member 308*a* and elongated support member 308*b*. Row 3040 of thin bricks may rest upon a support edge provided by upper extended lip 3080 of elongated support member 308*b* and may be positioned immediately beneath a lower extended lip 3084 of elongated support member 308*a*.

In an exemplary embodiment, after thin brick covering 304 is installed on support structure 300, grouting mortar may be used to fill the gaps between thin bricks to create a façade similar to that of a traditional brick wall. Referring to FIG. 2A, in an exemplary embodiment, perforated front wall 206 which is exposed between row of thin bricks may be covered using grouting mortar. In exemplary embodiments, perforations in perforated front wall 206 may allow grouting mortar to pour into an interior volume of elongated support member and ensure a better bound between adjacent row of thin bricks and the elongated support member.

In exemplary embodiments, utilizing a support structure similar to support structure 300 may allow for installing thin bricks on a wall without a need for adhesives to hold the bricks on the support structure or the need for mortar behind the support structure to attach the support structure to the wall. In exemplary support structure 300, panel 302 may be attached to a wall by screws or other similar fasteners and thin brick may be mounted to panel 302 by utilizing elongated support members such as elongated support members 308*a-e* without any adhesives needed to keep the bricks on support structure 300.

In exemplary embodiment, eliminating the need for adhesive materials to attach thin bricks on a wall by utilizing a support structure similar to support structure 300 may allow for a cost-effective and environmentally friendly installation of thin bricks on an front surface of the wall with a fast execution and a low risk of contaminating front surfaces of thin bricks with adhesive or other chemical materials.

Example

A thin brick may have a length of 100 mm to 330 mm, a thickness of 10 mm to 30 mm, and a width of 30 mm to 100 mm. In an exemplary embodiment, a support structure similar to support structure 300 of FIG. 3B may be utilized for installing thin bricks with different dimensions on a wall such as an exterior surface of a wall.

Referring to FIG. 3B, in an exemplary embodiment, adjacent tabs in each array of arrays of spaced-apart tabs 3024*a-e* may have a horizontal distance 310 of approximately between 100 mm and 165 mm. In an exemplary embodiment, adjacent arrays of spaced-apart tabs, for example, arrays 3024*a* and 3024*b* of spaced-apart tabs may have a vertical distance 312 of approximately between 40 mm and 310 mm. In an exemplary embodiment, each elongated support member, for example, elongated support member 3024*e* may have a length 314 of approximately between 5 cm and 100 cm.

Referring to FIG. 3A, in an exemplary embodiment, panel 302 may have a length 316 of approximately between 10 cm and 240 cm and a width 318 of approximately between 4 cm and 240 cm. In an exemplary embodiment, one or more panels similar to panel 302 may be tiled on a wall to cover the entire surface of the wall. Tiled panels may have side-to-side gaps of approximately 2 mm to 4 mm. In exemplary embodiments, tiling the panels may allow for avoiding bends and distortions in panels due to thermal expansion of the panels.

While the foregoing has described what are considered to be the best mode and/or other examples, it is understood that various modifications may be made therein and that the subject matter disclosed herein may be implemented in various forms and examples, and that the teachings may be applied in numerous applications, only some of which have been described herein. It is intended by the following claims to claim any and all applications, modifications, and variations that fall within the true scope of the present teachings.

Unless otherwise stated, all measurements, values, ratings, positions, magnitudes, sizes, and other specifications that are set forth in this specification, including in the claims that follow, are approximate, not exact. They are intended to have a reasonable range that is consistent with the functions to which they relate and with what is customary in the art to which they pertain.

The scope of protection is limited solely by the claims that now follow. That scope is intended and should be interpreted to be as broad as is consistent with the ordinary meaning of the language that is used in the claims when interpreted in light of this specification and the prosecution history that follows and to encompass all structural and functional equivalents. Notwithstanding, none of the claims are intended to embrace subject matter that fails to satisfy the requirement of Sections 101, 102, or 103 of the Patent Act, nor should they be interpreted in such a way. Any unintended embracement of such subject matter is hereby disclaimed.

Except as stated immediately above, nothing that has been stated or illustrated is intended or should be interpreted to cause a dedication of any component, step, feature, object, benefit, advantage, or equivalent to the public, regardless of whether it is or is not recited in the claims.

It will be understood that the terms and expressions used herein have the ordinary meaning as is accorded to such terms and expressions with respect to their corresponding respective areas of inquiry and study except where specific meanings have otherwise been set forth herein. Relational terms such as first and second and the like may be used solely to distinguish one entity or action from another without necessarily requiring or implying any actual such relationship or order between such entities or actions. The terms "comprises," "comprising," or any other variation thereof, are intended to cover a non-exclusive inclusion, such that a process, method, article, or apparatus that comprises a list of elements does not include only those elements but may include other elements not expressly listed or inherent to such process, method, article, or apparatus. An element proceeded by "a" or "an" does not, without further constraints, preclude the existence of additional identical elements in the process, method, article, or apparatus that comprises the element.

The Abstract of the Disclosure is provided to allow the reader to quickly ascertain the nature of the technical disclosure. It is submitted with the understanding that it will not be used to interpret or limit the scope or meaning of the claims. In addition, in the foregoing Detailed Description, it can be seen that various features are grouped together in various implementations. This is for purposes of streamlining the disclosure, and is not to be interpreted as reflecting an intention that the claimed implementations require more features than are expressly recited in each claim. Rather, as the following claims reflect, inventive subject matter lies in less than all features of a single disclosed implementation. Thus, the following claims are hereby incorporated into the Detailed Description, with each claim standing on its own as a separately claimed subject matter.

While various implementations have been described, the description is intended to be exemplary, rather than limiting and it will be apparent to those of ordinary skill in the art that many more implementations and implementations are possible that are within the scope of the implementations. Although many possible combinations of features are shown in the accompanying figures and discussed in this detailed description, many other combinations of the disclosed features are possible. Any feature of any implementation may be used in combination with or substituted for any other feature or element in any other implementation unless specifically restricted. Therefore, it will be understood that any of the features shown and/or discussed in the present disclosure may be implemented together in any suitable combination. Accordingly, the implementations are not to be restricted except in light of the attached claims and their equivalents. Also, various modifications and changes may be made within the scope of the attached claims.

What is claimed is:

1. A support structure for installing planar rows of thin bricks on a wall, the support structure comprising:

a panel mounted to a front surface of the wall;

a plurality of tabs extending from a front surface of the panel, the plurality of tabs arranged in a plurality of horizontal rows of spaced-apart tabs; and a plurality of elongated support members, each of the plurality of elongated support members removably attached to a corresponding horizontal row of spaced-apart tabs, each of the plurality of elongated support members comprising an upper support edge and a lower support edge, the upper support edge configured to support lower surfaces of thin bricks placed immediately above each elongated support member, the lower support edge placed above and in contact with upper surfaces of thin bricks placed immediately below each elongated support member, each elongated support member further comprising a front wall, a tangent plane to the front wall parallel with the tangent plane to the front surface of the panel, the front wall comprising:

a plurality of perforations on the front wall;

a plurality of upper lips extending from an upper edge of the front wall;

a plurality of lower lips extending from a lower edge of the front wall;

a front surface facing away from the front surface of the wall; and a rear surface facing the front surface of the wall.

2. The support structure according to claim 1, wherein each of the plurality of tabs perpendicularly extended from the front surface of the panel along a surface normal of the panel.

3. The support structure according to claim 2, wherein each tab of the plurality of tabs comprises an aperture, a tangent plane to the aperture perpendicular to a tangent plane to the front surface of the panel.

4. The support structure according to claim 1, wherein each elongated support member further comprises a latching mechanism configured to removably attach each elongated support member to a corresponding horizontal row of spaced-apart tabs, the latching mechanism comprising:

a plurality of protruded tongues attached to the rear surface of the front wall, each protruded tongue of the plurality of protruded tongues associated with and latched onto each tab of the corresponding horizontal row of spaced-apart tabs.

5. The support structure according to claim 4, wherein each protruded tongue of the plurality of protruded tongues comprises a protrusion along an axis parallel to a tangent plane of the front wall.

6. The support structure according to claim 4, wherein each protruded tongue of the plurality of protruded tongues mates with the aperture of each tab of the corresponding horizontal row of spaced-apart tabs.

7. The support structure according to claim 4, wherein the latching mechanism further comprises an upper arched arm, the upper arched arm configured to attach the plurality of protruded tongues to the rear surface of the front wall, the upper arched arm comprising:

a first upper portion attached to and extending from the rear surface of the front wall;

a first front curved portion extending from the first upper portion curving downward and toward the rear surface of the front wall; and a first lower portion extending straight from the first front curved portion toward the rear surface of the front wall, wherein the plurality of protruded tongues attached to the first lower portion, each protruded tongue of the plurality of protruded tongues comprising a protrusion along a surface normal of the first lower portion.

8. The support structure according to claim 7, wherein the latching mechanism further comprises a lower arched arm, the lower arched arm comprising:

a second lower portion attached to and extending from the rear surface of the front wall;

a second front curved portion extending from the second lower portion curving upward and toward the rear surface of the front wall; and a second upper portion extending straight from the second front curved portion toward the rear surface of the front wall, wherein a plurality of slot cut into the second upper portion, each slot of the plurality of slots associated with a protruded tongue of the plurality of protruded tongues.

9. The support structure according to claim 4, wherein each protruded tongue of the plurality of protruded tongues comprising a V-shaped protrusion along an axis parallel to a tangent plane of the front wall.

10. The support structure according to claim 4, wherein the plurality of lower lips of a first elongated support member of the plurality of elongated support members are spaced apart from the plurality of upper lips of a second elongated support member positioned below the first elongated support member by an amount equal to a width of each row of thin bricks mounted between the first elongated support member and the second elongated support member.

11. The support structure according to claim 1, wherein the panel comprises one or more countersunk holes, each countersunk hole of the one or more countersunk holes protruding from a rear surface of the panel creating a space between the front surface of the wall and the rear surface of the panel, the panel attached to the front surface of the wall by fastening one or more countersunk fasteners through the one or more countersunk holes.

12. The support structure according to claim 1, further comprising an insulating layer positioned between the front surface of the wall and the rear surface of the panel.

13. A method for installing thin bricks on a front surface of a wall, the method comprising:

mounting a panel to the front surface of the wall, the panel comprising a plurality of tabs extending from a front surface of the panel, the plurality of tabs arranged in a plurality of horizontal rows of spaced-apart tabs;

latching a plurality of elongated support members onto corresponding horizontal rows of spaced-apart tabs, each elongated support member further comprises a front wall, a tangent plane to the front wall parallel with the tangent plane to the front surface of the panel, the front wall comprising:

a plurality of perforations on the front wall;

a plurality of upper lips extending from an upper edge of the front wall;

a plurality of lower lips extending from a lower edge of the front wall;

a front surface facing away from the front surface of the wall; and a rear surface facing the front surface of the wall;

placing rows of thin bricks above corresponding plurality of elongated support members; and fixing the rows of thin bricks between two elongated support members of the plurality of elongated support members by depositing a grouting mortar material on the front surface of the panel between the rows of thin bricks.

* * * * *